US005120587A

United States Patent [19]

McDermott, III et al.

[11] Patent Number: 5,120,587

[45] Date of Patent: Jun. 9, 1992

[54] SUPPORT BINDER

[75] Inventors: Lewis J. McDermott, III; Lewis P. McDermott, both of Cartersville, Ga.

[73] Assignee: Optimum Technologies, Inc., Cartersville, Ga.

[21] Appl. No.: 603,304

[22] Filed: Oct. 25, 1990

[51] Int. Cl.[5] ..... B32B 3/10; B32B 5/18; B32B 5/24

[52] U.S. Cl. ..... 428/40; 428/137; 428/138; 428/247; 428/255; 428/354; 428/304.4; 428/95; 427/208.4; 427/389.9; 427/394

[58] Field of Search ..... 428/40, 137, 138, 247, 428/255, 109, 110, 354, 304.4; 427/208.4, 389.9, 394

[56] References Cited

U.S. PATENT DOCUMENTS

| | | | |
|---|---|---|---|
| 4,144,371 | 3/1979 | Okie et al. | 428/255 |
| 4,405,668 | 9/1983 | Wald | 428/40 |
| 4,535,021 | 8/1985 | Friedrich | 428/137 |
| 4,557,774 | 12/1985 | Hoopengardner | 428/198 |

*Primary Examiner*—Alexander S. Thomas
*Attorney, Agent, or Firm*—Stoll, Previto & Hoffman

[57] ABSTRACT

A support binder in the form of a scrim having a plurality of spaced frame elements forming openings. Foam material surrounds said frame elements and extends into some of said openings. The foam material has a pressure-sensitive adhesive coating thereon. Preferably, the foam material comprises support pillows which extend into and substantially close alternate openings to give a checkerboard configuration to the support binder.

34 Claims, 2 Drawing Sheets

SUPPORT BINDER

BACKGROUND

The present invention is directed to an improved binder for carpeting and more particularly to an improved support binder to be used for holding carpets and area rugs onto floors or other carpets.

The present invention is an improvement over the binder disclosed in Ward's U.S. Pat. No. 4,234,649 and Ward's U.S. Pat. No. 4,405,668 which are owned by the same entity which owns this application, the disclosures of which are incorporated herein by reference.

When laying down wall-to-wall carpeting, or when placing an area rug on the floor or over other carpeting, pads and cushions are often placed beneath the rugs or carpets to improve the wear and tear on the carpet or rug. Over the years, a number of such pads and cushions have been used to accomplish this purpose. Examples of some of these earlier pads and cushions are disclosed in Langerfeld German Utility Model No. 7,124,118 and Hoopengarden's U.S. Pat. Nos. 4,557,774 and 4,797,170. A number of problems arise with the use of these earlier pads and cushions.

Some installation systems require additional adhesives to be applied either to the floor or to the pad at the installation site and in still other systems the carpets are not removable and reusable without damage to the pad, floor or carpet.

In some glue-down installations, there is danger of toxic fumes or odors which sometimes produce a "sick building" syndrome. Other glue-down installations are very slow since it is necessary to determine the proper glue to be used and the amount of glue used, and the glue must be placed on either the floor, or pad, or carpet. There is also the danger that some glue may go on the face of the carpet and damage it. Moreover, with glue installation open time is required to cure the glue and the carpet cannot be used immediately because of this. In glue-down installations, the carpet cannot be adjusted with ease which is a particular drawback when patterned carpet is installed and must be matched at the seams. In glue-down installations, removal of the carpet or pad is expensive and floors must be refinished in order to be recovered and be used with a different carpet.

In other types of installation, tackless strips are required. In such installations the carpet is placed over a pad and stretched over the tackless strips. Only a professional using special tools can do this.

Another problem is delamination and wrinkling of the carpet which sometimes occurs with certain pads. Delamination occurs when the carpet backing separates from the carpet face.

Also, with the tackless and glue-down methods, if the carpet gets wet it cannot be easily removed to be dried and may even be permanently damaged.

Another problem with the prior art systems is that they cannot be made rigid, and so the carpet or tile is not dimensionally stable.

Also, with these prior art systems one side does not have greater adhesive strength than the other side.

Some additional installation problems arise from cushions or pads consisting of a web reinforcement interposed between two layers of solid foam backing over which a pressure-sensitive adhesive is applied. These do not have the ability to breathe since they are solid and they can also not be easily removed from the floor.

Furthermore, since existing cushions or pads are solid and do not have the capability of permitting air to flow through, it is difficult for heat to pass therethrough and moisture does not easily evaporate thus becoming trapped under the pad and creating mildew.

OBJECTS

The present invention overcomes the disadvantages outlined above and has for one of its objects an improved support binder which avoids carpet delamination, wrinkling or other damage.

Another object of the present invention is the provision of an improved support binder which will prevent the foam from becoming detached from the binder.

Another object of the present invention is the provision of an improved support binder which prevents the plasticizer from migrating.

Another object of the present invention is the provision of an improved support binder which may be made rigid so that the carpet or tile installed with the binder can be dimensionally stable.

Another object of the present invention is the provision of an improved support binder in which the adhesive strength on one side may be greater than the adhesive strength on the other side.

Another object of the present invention is the provision of an improved support binder which will not require additional adhesives to be applied either to the floor, the carpet or the binder at the installation site.

Another object of the present invention is the provision of an improved support binder which is removable and reusable without damage to the binder, floor or carpet.

Another object of the present invention is the provision of an improved support binder which will not have any toxic fumes or odors and which will avoid "sick building" syndrome.

Another object of the present invention is the provision of an improved support binder wherein installation of carpets will be much quicker since it is not necessary to apply any glue either on the floor, the binder or the carpet.

Another object of the present invention is the provision of an improved support binder which will make it unnecessary to determine the proper glue to use and wherein there is no danger that any glue will go on the face of the carpet as to damage it.

Another object of the present invention is the provision of an improved support binder which will make it unnecessary to determine the correct amount of glue needed since the binder itself already has glue on it.

Another object of the present invention is the provision of an improved support binder which does not require open time to cure the glue.

Another object of the present invention is the provision of an improved support binder which has tax advantages over other underlay systems since the carpet installation can be deemed removable, reusable, and thus not permanent.

Another object of the present invention is the provision of an improved support binder which eliminates the use of tackless strips so that the binder may be installed by laymen without special tools and with ease since it is not necessary to stretch the carpet.

Another object of the present invention is the provision of an improved support binder wherein a plastic liner covers the upper surface of the binder to permit the carpet to be repeatedly adjusted during installation which is of particular importance when a patterned carpet must be matched at the seams.

Another object of the present invention is the provision of an improved support binder which allows for an installation that is less expensive because installers can install carpeting faster, and because there is no requirement for expensive stretching equipment.

Another object of the present invention is the provision of an improved support binder wherein removal expense will be greatly decreased when the carpet and the binder are to be removed.

Another object of the present invention is the provision of an improved support binder wherein floors can be recovered immediately upon removal of the carpet since the floor is clean and immediately ready for a new carpet.

Another object of the present invention is the provision of an improved support binder wherein the carpet can be used immediately as soon as it is installed and can be walked on immediately since there is no glue and no curing time.

Another object of the present invention is the provision of an improved support binder which permits the carpet to be easily removed and dried and put back down again if it ever gets wet.

Another object of the present invention is the provision of an improved support binder having openings therein which permit the ready and easy flow of air through the support binder. This permits heat to flow therethrough and prevents liquids from being trapped therebeneath. Other and further objects of the invention will be obvious upon an understanding of the illustrative embodiment about to be described, or will be indicated in the appended claims and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings forming a part of the specification, wherein.

DESCRIPTION

Figure 1A:
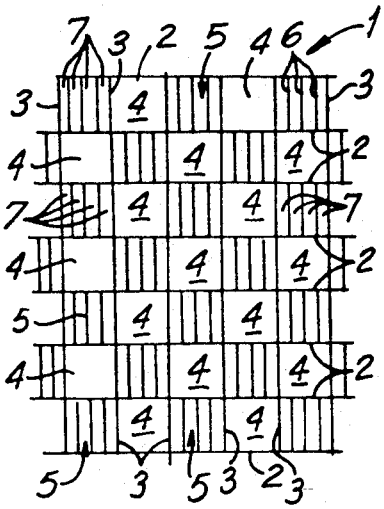
FIG. 1*a* is a schematic plan view of a scrim which is used in the formation of the support binder of the present invention.
Figure 1B:
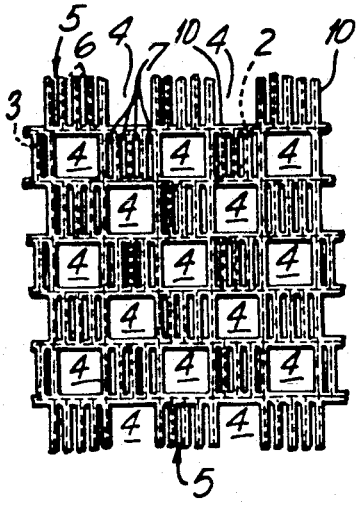
FIG. 1*b* is a view similar to FIG. 1*a* showing the scrim of FIG. 1*a* coated with a foamable material before foaming.

Referring to the drawings, and particularly to FIGS. 1*a* to 5, the support binder B of the present invention comprises a scrim 1 which is preferably made of a plurality of parallel first frame elements or threads 2 and a plurality of parallel second frame elements or threads 3 which intersect each other to form a plurality of first and second alternate square openings 4 and 5 respectively, between first and second threads 2 and 3. The scrim 1 may be formed by weaving, knitting or by any other well known method so that the first and second frame elements 2 and 3 may intersect with each other either by alternately crossing over and under each other (FIG. 6) or by being formed planar to each other (FIG. 1*a*). The first and second alternate openings 4 and 5 are different types of openings, as will be more fully explained hereinbelow. In the drawings, the scrim 1 is shown as having the first and second threads 2 and 3 as being parallel, at right angles to each other and equidistance to each other to form the plurality of first and second alternate square openings 4 and 5. However, it will be understood that the positions of the first and second threads 2 and 3 may be changed so that the scrim 1 may have a configuration other than that shown in FIG. 1*a* and still be within the purview of the present invention.

First alternate openings 4 are devoid of anything and remain empty. However, second alternate openings 5 are provided with a plurality of span threads 6 which bridge second alternate openings 5 to connect main first threads 2 together and to form a plurality of rectangular spaces 7 which are thin and parallel to each other. The span threads 6 are parallel to each other and to the second threads 3. This forms the scrim 1 into a checkerboard pattern where second alternate openings 5 have span threads 6 therein and first alternate openings 4 are empty and devoid of any span threads. While the span threads 6 are shown as being preferably perpendicular to the first threads 2 and parallel to each other and second threads 3, it will be understood that the span threads 6 may assume different positions in second alternate openings 5 without departing from the invention.

The scrim 1 is coated with a foamable material 10 so that the entire periphery of each first and second threads 2 and 3 as well as the entire periphery of each span thread 6 is coated with the foamable material 10. Preferably, there is no foamable material in the first alternate openings 4 which do not have any span threads 6. Any well known or conventional means may be used to prevent the foamable material 10 from being deposited in the first alternate openings 4 which have no span threads 6 therein. For example, checkerboard masking sheets (not shown) may be used during the coating operation to prevent any of the foamable material 10 from spreading in the first alternate openings 4. It is also possible to chemically inhibit the foamable material from spreading into the first alternate openings 4; or it is possible to limit the amount of foamable material on the first and second threads 2 and 3 so that when the foamable materials is blown it will not spread into the first alternate openings 4.

In addition, it is possible to limit the deposition of the foamable material 10 in the first alternate openings 4 by squeezing the coating through a nip roller. In addition, it may be possible to either dip coat or blow coat the scrim 1 and thereafter blow out the foamable material from the first alternate openings 4.

Figure 1C:
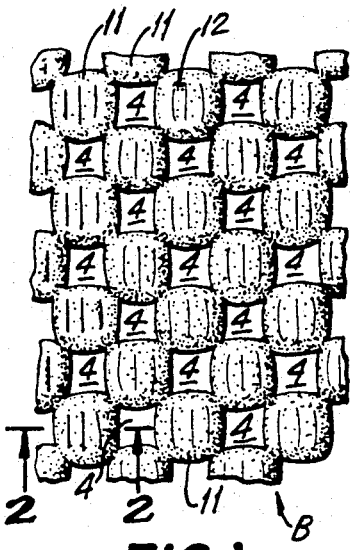
FIG. 1*c* is similar to FIGS. 1*a* and 1*b* showing the support binder after the foamable material has been foamed.
Figure 2:
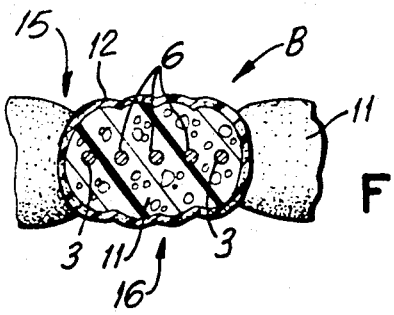
FIG. 2 is a sectional view taken along line 2—2 of FIG. 1*c*.
Figure 3:
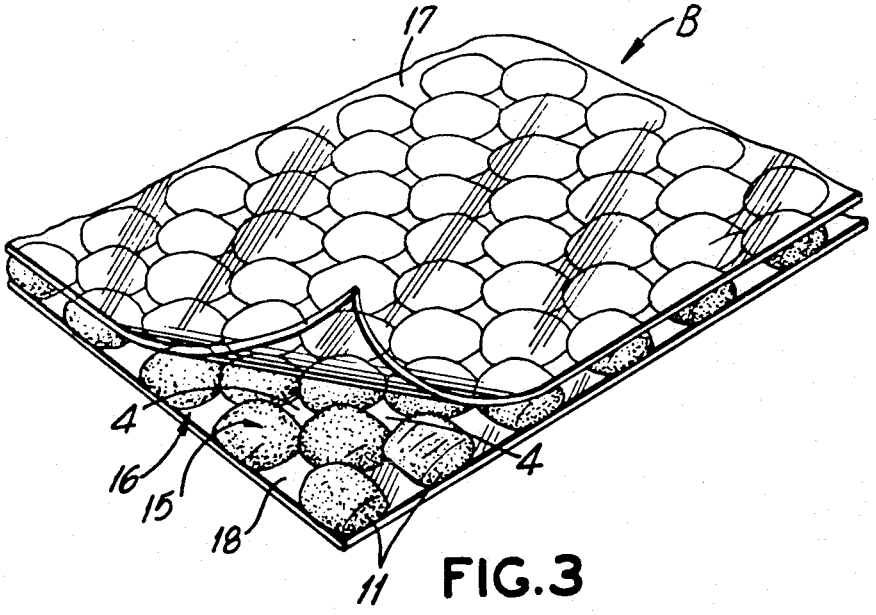
FIG. 3 is a perspective view showing the support binder of the present invention ready to be used.

The foamable material 10 is then subjected to heat or other chemical process for a certain amount of time so that the foamable material 10 will blow up or foam to form a resilient support pillow 11 in each of the second alternate openings 5, as shown in FIG. 1*c*. It will be noted that the foam material of the support pillows 11 completely fills the spaces 7 between the span threads 6 in second alternate openings 5 as well as the spaces between first and second threads 2 and 3 in second alternate openings 5. In effect, when the foamable material 10 in the second alternate openings 5 blows up, the foamable material 10 on the first and second threads 2 and 3 and on the span threads 6 will expand and fuse and will merge into each other to become a single foam support pillow 11 which completely fills the second alternate spaces 5. It will be noted that while the foamable material 10 on the first and second threads 2 and 3 forming first alternate empty openings 4 expands slightly into the first alternate empty openings 4, the openings 4 remain free of any foam material.

In effect, the resulting structure is a support binder B having planar upper and lower faces 15 and 16, respectively, and presenting a checkerboard pattern having alternate open spaces 4 devoid of any foam material separated by alternate foam support pillows 11. The alternation of the support pillows 11 with the open spaces 4 in a checkerboard pattern extends planarly in all directions. The support pillows 11 are thick as compared to the thickness of the first and second threads 2 and 3 and the span threads 6. The support pillows 11 are spongy, pliable and resilient.

The support binder B preferably has a pressure-sensitive adhesive 12 rolled over at least one face of the support binder B. In the drawing, the entire outer surfaces of the support pillows 11 are coated with a thin coating of a pressure-sensitive adhesive 12. However, it is within the purview of the present invention to coat less than the entire surface of the support pillows 11. If desired, pressure-sensitive adhesive 12 may also be sprayed onto the support binder B or may be dipped in a bath of pressure-sensitive adhesive. The preferred pressure-sensitive adhesive is a non-oxidizing pressure-sensitive adhesive comprising permanently tacky modified acrylic vinyl acetate-ethylene copolymer material. A pair of release liners 17 and 18 are applied to the upper and lower faces 15 and 16 of the support binder B in order to prevent the support binder B from sticking either to itself or some other article until it is ready to be used. The release liners 17–18 shown in the drawings may be made of vinyl or polyethylene or any other suitable material. In the drawings, a pair of release liners 17 and 18 have been shown. While two release liners 17 and 18 are shown in the drawing, it is also within the purview of the present invention to use a single release liner 17 or 18 attached to one face 15 or 16 of the support binder B. In addition, the release liners 17 or 18, or both, may have openings therein.

The foam support pillows 11 in the openings 5 may be formed in any well-known manner. Both closed cell and open cell technology may be used in order to form the foam support pillows 11 in the openings 5. One preferred method of forming the resilient foam pillows 11 comprises coating the first and second threads 2 and 3 and the span threads 6 of the scrim 1 with the foamable material 10. The foamable material 10 perferably comprises a mixture of polyvinyl chloride (hereinafter PVC), a plasticizer such as dioctyl-phthalate (hereinafter DOP) and a blowing agent such as azodicarbonamide (hereinafter AZO). It has been found that 100 parts of DOP to about 100 parts of PVC and 2 to 4 parts of AZO give excellent results. It is also possible to make the foamable material from urethane, latex or any other material which will blow into a foam either chemically or mechanically. For example, 4, $4^1$-oxybis (benzene sulponyl) hydrazine (OBSH) may be used without departing from the present invention. The scrim 1 with the foamable material 10 is placed in an oven at about 400° F. for about one minute so that it blows up and foams into a spongy consistency to form the pillows 11.

Details of other foaming agents which may also be used in connection with this invention are described in *Modern Plastics* Mid-October 1989–90 Encyclopedia issue on pages 184, 187, 188, 274, 276, 278, 279, 282, 283 and 286, was well as page 626 of the *Modern Plastics* 1984–85 Encyclopedia issue, both of which are incorporated herein by reference.

Alternative polymers, plasticizers and foaming agents may be used. A list of foaming agents for various thermoplastics is presented on page 628 of the *Modern Plastics* 1984–85 Encyclopedia issue, which is incorporated herein by reference. Specific chemicals cited for use with flexible PVC (plasticized PVC) from this list are azodicarbonamide, dinitrosopentamethylenetetramine, 4, $4^1$-oxybis (benzenesulfonyl) hydrazine and p-toluenesulfonyl semicarbazide. Other foaming agents could be used.

A wide variety of plasticizers can be used in lieu of DOP. General criteria for the selection of plasticizers are presented on pages 200 and 203 of the *Modern Plastics* 1989–90 Encyclopedia issue and a list of candidate plasticizers is presented on pp. 668–677 of the same issue. These pages are incorporated herein by reference. The choice and amount of plasticizer depends on the compatibility and flexibilizing efficiency of the plasticizer for the base polymer.

Other polymers aside from PVC may also be used. Thermoplastic elastomers can be used instead of plasticized PVC. Plasticized polymethyl methacrylate (PMMA) or plasticized polystyrene (PS) could be substituted for plasticized PVC to achieve similar mechanical performance. PS and PMMA are less desirable than PVC because of flammability considerations. Polyolefins can also be converted into flexible foams for use in the support binder.

As indicated above, methods of producing thermoplastic foams by extrusion are summarized on pp. 274, 276 and 278 of *Modern Plastics* 1989–90 Encyclopedia issue. The foam extrudate can be used to coat the threads directly.

Reactive foaming may also be used to make the foamed pillows. Reactants to produce flexible urethane foam can be doctored onto the scrim. A sizing die or moving contoured belt can be used to control the shape of pillows as the urethane cures. Polyurethane foam processing is summarized on pp. 279–286 of the *Modern Plastics* 1989–90 Encyclopedia issue. In general, a polyol (such as a polyether) may be reacted with an isocyanate to form a flexible foam.

In addition, the support binder may be formed or coated with a urethane barrier in order to prevent the migration of the plasticizer.

Figure 4:
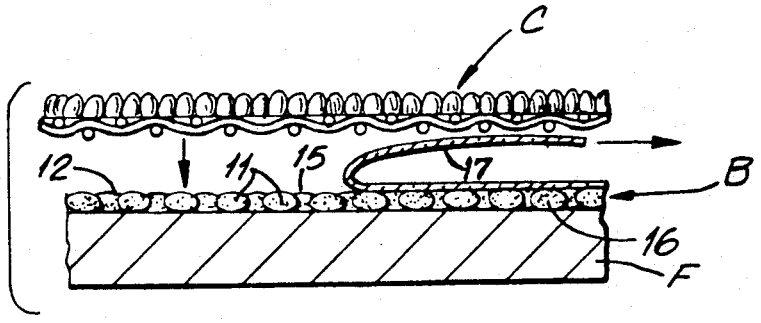
FIG. 4 is a sectional view showing one way of using the support binder of the present invention to hold a carpet onto a floor.
Figure 5:
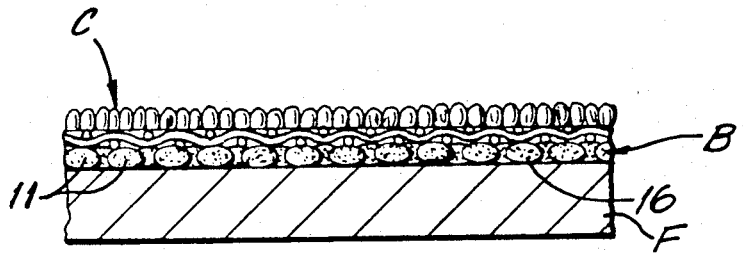
FIG. 5 is a sectional view similar to FIG. 4 showing the support binder holding a carpet on to a floor.

The support binder B made in accordance with the present invention may be used to install wall-to-wall carpeting C as is shown in FIGS. 4 and 5 or may be used to install an area rug over a floor or over another rug or carpet. The manner of installing the support binder B and a carpet C is shown in FIGS. 4 and 5 and is substantially identical to the manner of installing the binder and carpet shown in U.S. Pat. No. 4,234,649.

At the installation site the support binder B is placed on the floor F with its lower face 16 on the floor and held thereon by the pressure-sensitive adhesive coating 12 on pillows 11. Thereafter, a carpet C is placed over the support binder B and over the upper release liner 17 covering its upper face 15. All the necessary cutting, seaming, etc. may be performed to the carpet C before the upper release liner 17 is removed from the upper face 15 of the support binder B. Thereafter, the liner 17 is removed and the carpet C is placed over the top face 15 of the support binder B and held thereon by the pressure-sensitive adhesive coating 12 on pillows 11.

With this construction the support binder B will support a rug or carpet C and prevent it from slipping, moving, wrinkling, etc. The carpet C may be easily removed from the upper face 15 of the support binder B because of the pressure-sensitive adhesive 12 that is holding the carpet C to it. The support binder B may also be easily removed from the floor F because it is held there by the pressure-sensitive adhesive coating 12 on the pillows 11.

Figure 6:
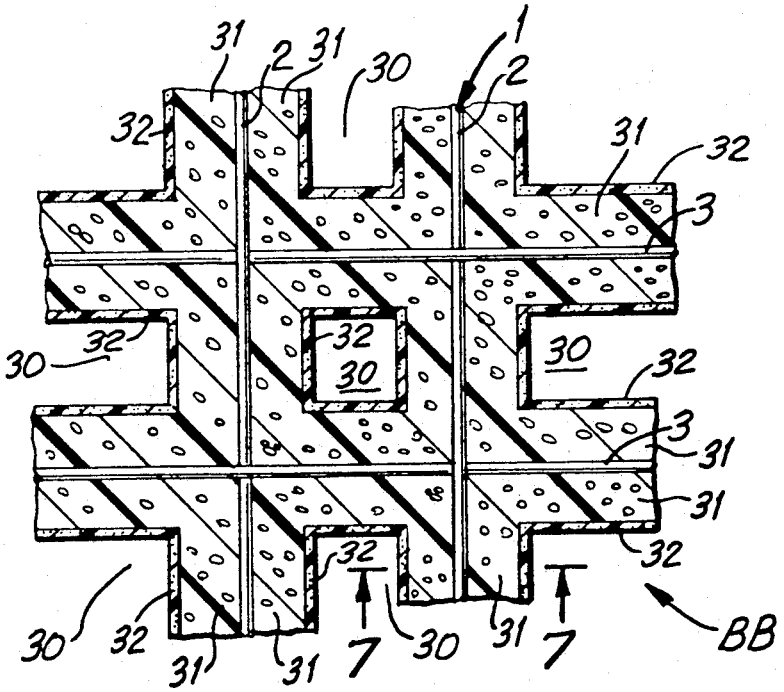
FIG. 6 is a schematic plan view showing another embodiment of the support binder of the present invention.
Figure 7:
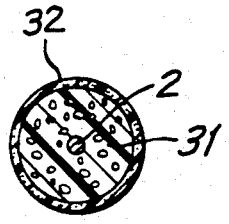
FIG. 7 is a sectional view taken along line 7—7 of FIG. 6.

FIGS. 6 and 7 show another embodiment of the present invention. In this embodiment, the scrim 1 comprises first and second threads 2 and 3 at right angle to each other. First and second threads 2 and 3 may be woven, knitted or made in any other well known manner. In this embodiment, the scrim 1 does not have the checkerboard configuration of the embodiment of the invention shown in FIGS. 1*a* to 5. Rather, in this embodiment, all the spaces 30 formed by the first and second threads 2 and 3 are open. Each of the first and second threads 2 and 3 is coated with a foamable material (similar to the one described in connections with FIGS. 1*a*–5) so as to cover the first and second threads 2 and 3. Each of the first and second threads 2 and 3 is coated with the foamable material so as to cover the entire periphery of the first and second threads 2 and 3.

When the foamable material is blown up, it forms a spongy foam coating 31 which surrounds and completely covers each of the intersecting first and second threads 2 and 3. However, the foam coating 31 intrudes only partially into each of the open spaces 30 so that an opening 30 is left in each of the open spaces formed by the intersecting first and second threads 2 and 3. In a manner similar to the embodiment of FIGS. 1*a* to 5, the spongy foam coating 31 is much thicker than the underlying first and second threads 2 and 3 to give the finished support binder BB sufficient resiliency to support a carpet or an area rug.

The support binder BB is then dipped in a bath of pressure-sensitive adhesive to form a thin coating 32 thereof over the thick foam coating 31. This may also be accomplished by spraying or rolling. Upper and lower release liners (similar to those shown in the embodiment of FIGS. 1*a* to 5) may then be applied to the upper and lower faces of the finished support binder BB. As described in the embodiment of FIGS. 1*a*–5, a single release liner may be used and the release liners may have openings therein. The use of the support binder BB is the same as that described in connection with the embodiment of FIGS. 1*a*–5.

It will thus be seen that the present invention provides an improved support binder which avoids carpet delamination, wrinkling or other damage, which will prevent the foam from becoming detached from the binder, which prevents the plasticizer from migrating and which may be made rigid so that carpet or tile installed on the binder can be dimensionally stable. With the improved support binder of the present invention, the adhesive strength on one side may be greater than the adhesive strength on the other side and with pressure-sensitive adhesive coating on the binder, additional adhesives need not be added either to the floor, the carpet or the binder at the installation site. The support binder is removable and reusable without damage to the pad, floor or carpet, and will not have any toxic fumes or odors (to avoid "sick building" syndrome). Moreover, installation of carpets with the present invention will be much quicker since it is not necessary to apply any glue either on the floor, the binder or the carpet and it will not be necessary to determine the proper glue for installation. It will also be seen that the support binder may, in accordance with the present invention, have openings therein which permit the free and easy flow of air therethrough.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A support binder having opposed upper and lower planar faces, comprising a scrim having a plurality of intersecting first and second frame elements, said first frame elements being spaced from each other and said second frame elements being spaced from each other to form a plurality of openings, foam material surrounding the periphery of each of said first and second frame elements and extending substantially the same distance from the frame elements in the direction of said upper and lower planar faces, said foam material extending at least partially into said openings, at least a portion of said support binder having a pressure-sensitive adhesive coating thereon.

2. A support binder as claimed in claim 1, wherein said frame elements form first openings alternating with second openings.

3. A support binder as claimed in claim 2, wherein said form material extends into and substantially closes said second alternate openings to give the support binder a checkerboard appearance.

4. A support binder as claimed in claim 3, wherein said foam material comprises support pillows closing said second alternate openings.

5. A support binder as claimed in claim 4, wherein said support pillows have a thickness greater then the thickness of the frame elements.

6. A support binder as claimed in claim 5, wherein said second openings comprise a plurality of thread segments and wherein said thread segments connect said spaced first threads together.

7. A support binder as claimed in claim 6, wherein said first and second threads are perpendicular to each other.

8. A support binder as claimed in claim 7, wherein said thread segments are parrallel to each other and to said second threads and are perpendicular to said first threads.

9. A support binder as claimed in claim 8, wherein the said pressure-sensitive adhesive coating surrounds said foam material.

10. A support binder as climed in claim 9, wherein the pressure-sensitive adhesive coating coats each of the said support pillows.

11. A support binder as claimed in claim 10, wherein at least one release liner is mounted on one face of the support binder.

12. A support binder as claimed in claim 11, wherein openings are provided in said release liner.

13. A support binder as claimed in claim 11, wherein a release liner is mounted on each face of the support binder.

14. A support binder as claimed in claim 11, wherein a urethane barrier coats said foam material.

15. A support binder as claimed in claim 11, wherein the foam material comprises polyvinyl chloride and a plasticizer.

16. A support binder as claimed in claim 15, wherein foam material comprises 100 parts of polyvinyl chloride to 100 parts of plasticizer.

17. A support binder as claimed in claim 15, wherein said plasticizer is dioctyl-phthalate.

18. A support binder as claimed in claim 11, wherein said pressure-sensitive adhesive is modified acrylic vinyl acetate-ethylene copolymer material.

19. The method of making a support binder with opposed upper and lower spaced planar faces from a scrim having a plurality of spaced intersecting first and second frame elements to form a plurality of first and second alternate openings, comprising coating said first and second frame elements with a foamable material, causing the foamable material to expand to form a foam material, causing the expansion of the foam material to extend for substantially the same distance from the frame elements in the direction of said upper and lower planar faces, and coating at least a portion of the support binder with a pressure-sensitive adhesive.

20. A method as claimed in claim 19, wherein the foamable material is caused to expand into and to substantially close said second openings.

21. A method as claimed in claim 20, wherein the foamable material is caused to expand into pillows which are thicker than the frame elements.

22. A method as set forth in claim 31, wherein the pillows are formed in said second openings in the scrim.

23. A method as set forth in claim 22 wherein the foamable material comprises polyvinyl chloride, a plasticizer and a blowing agent.

24. A method as set forth in claim 23 wherein 100 parts polyvinyl chloride and 100 parts plasticizer are used.

25. A method as set forth in claim 24 wherein about 2–4 parts of the blowing agent is used.

26. A method as set forth in claim 25 wherein the palsticizer is dioctyl-phthalate.

27. A method as set forth in claim 26 wherein said blowing agent is azodicarbonamide.

28. A method as set forth in claim 27 wherein the foamable material is heated to blow it up.

29. A method as set forth in claim 28 wherein the foamable material is heated to a temperature of approximately 400° Fahrenheit.

30. A method as set forth in claim 29 wherein said foamable material is heated for approximately one minute.

31. A method as set forth in claim 30 wherein said pressure-sensitive adhesive is rolled onto the scrim.

32. A method as set forth in claim 31 wherein said pressure-sensitive adhesive comprises modified acrylic vinyl acetate-ethylene copolymer material.

33. A method as set forth in claim 32 wherein a release liner is applied over at least one face of the support binder.

34. A method as set forth in claim 22 wherein the pressure-sensitive coating is applied over the said support pillows.

* * * * *

UNITED STATES PATENT AND TRADEMARK OFFICE

CERTIFICATE OF CORRECTION

PATENT NO. : 5,120,587

DATED : June 9, 1992

INVENTOR(S) : Lewis J. McDermott, III, et al

It is certified that error appears in the above-indentified patent and that said Letters Patent is hereby corrected as shown below:

Column 10, line 7, cancel "31" and substitute---21---

Signed and Sealed this

Twelfth Day of October, 1993

Bruce Lehman

*Attest:*

BRUCE LEHMAN

*Attesting Officer*

*Commissioner of Patents and Trademarks*